United States Patent [19]

Hancock

[11] 4,087,070

[45] May 2, 1978

[54] SWIVEL CHAIR WITH NON-KEYWAYED MAIN SCREW

[75] Inventor: William L. Hancock, Lexington, Ky.

[73] Assignee: Hoover Ball and Bearing Company, Saline, Mich.

[21] Appl. No.: 730,380

[22] Filed: Oct. 7, 1976

[51] Int. Cl.[2] ..... F16M 11/26

[52] U.S. Cl. ..... 248/406; 151/7

[58] Field of Search ..... 248/406, 405, 354 S

[56] References Cited

U.S. PATENT DOCUMENTS

| | | | |
|---|---|---|---|
| 2,359,966 | 10/1944 | Bolens | 248/406 |
| 3,164,357 | 1/1965 | Hage et al. | 248/406 |
| 3,642,244 | 2/1972 | Textoris | 248/406 |

FOREIGN PATENT DOCUMENTS

| | | | |
|---|---|---|---|
| 962,936 | 2/1975 | Canada | 248/405 |
| 36,785 | 5/1906 | Switzerland | 248/405 |
| 1,045,510 | 10/1966 | United Kingdom | 248/405 |

*Primary Examiner*—Marion Parsons, Jr.

*Attorney, Agent, or Firm*—Olsen and Stephenson

[57] ABSTRACT

A swivel chair having a non-keywayed main screw rotatably connecting the chair seat and a supporting base to enable rotational movement of the seat with respect to the base. The top portion of the main screw is secured to the bottom of the seat, and the bottom portion is contained in the base for rotation therein. A ring shaped member, formed of a high coefficient of friction material such as rubber, is mounted on the screw at a position above the base. A nut is mounted on the screw and has a threaded portion the bottom of which comes in contact with the ring shaped member which is in turn rotatably mounted on the base by a washer formed of Teflon or similar low friction material. During normal rotation of the seat and thus the screw, the ring shaped member serves to grip the nut and rotate it with the screw, thereby keeping the seat at a constant vertical position. Relative rotational movement of the screw and the nut, which is accomplished manually, causes an effective raising or lowering of the vertical position of the seat relative to the base.

3 Claims, 1 Drawing Figure

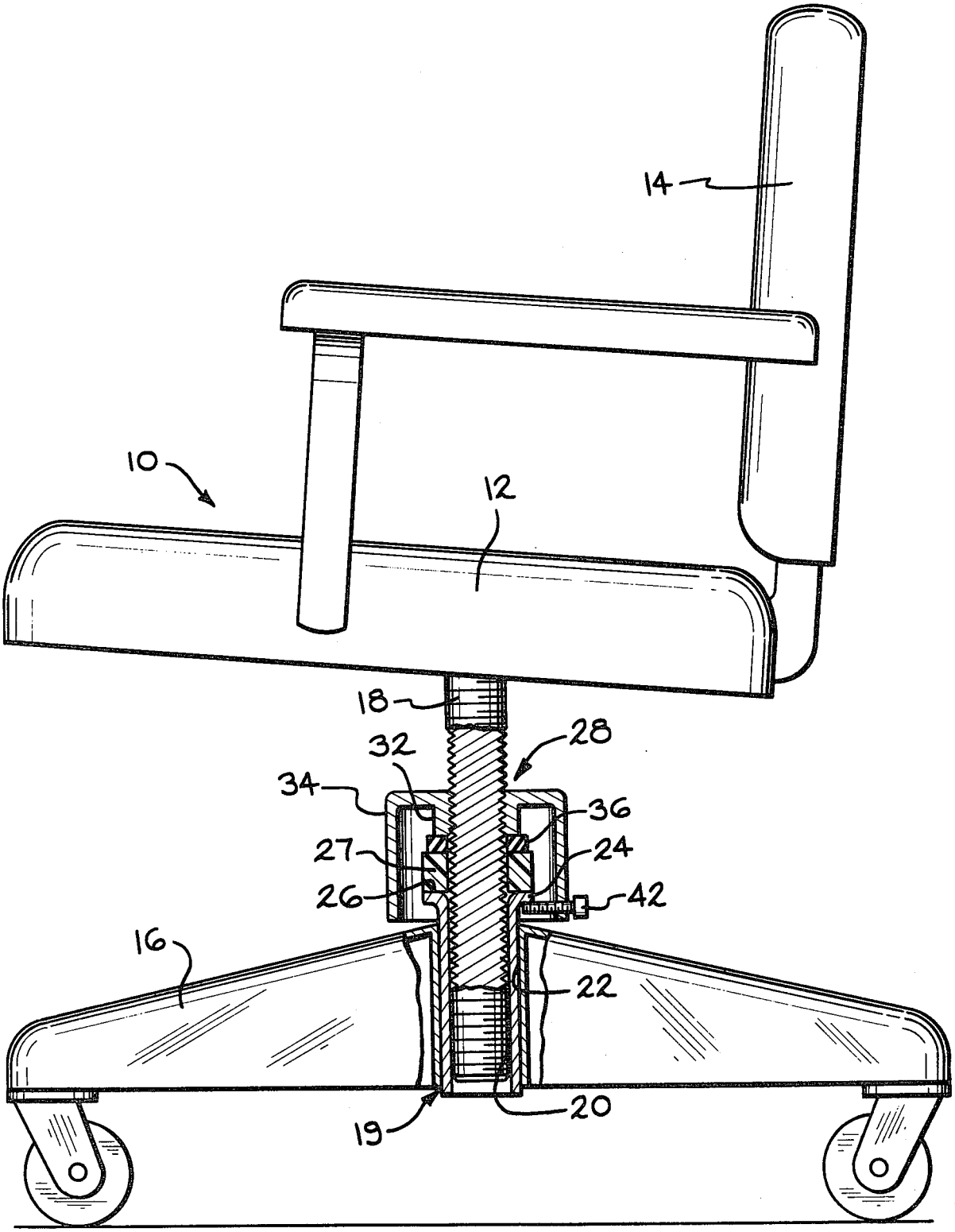
14
10
12
18
28
32
34
36
27
24
26
42
16
22
20
19

SWIVEL CHAIR WITH NON-KEYWAYED MAIN SCREW

BACKGROUND OF THE INVENTION

In swivel chairs having a seat and a main screw secured to the bottom of the seat and rotatably mounted on a supporting base, it is considered essential to prevent "piano stooling," namely, to keep the vertical level of the seat constant while the seat is being rotated. It has been common practice to provide a nut assembly on the screw which will normally rotate with the screw, keeping the seat level constant, but which can be manually rotated relative to the screw for adjustment of the seat height. In the past, a keyway has been provided on the screw and a washer, having an inwardly facing key interfitting in the screw keyway, has been mounted on the screw. A nut has been threadably mounted on the screw above the washer. When the seat and the screw turn, the washer also turns, and since the nut comes in contact only with the washer and the screw, it rotates identically with them. To adjust the height of the seat it has been necessary to grasp the nut and manually rotate it on the screw. Thus, in commercially successful swivel chairs of this type, a keywayed main screw has been essential.

The keywayed main screws utilized in the prior art devices have often been subject to failure because of stresses induced in the area of the keyway. Increasing the size of the screw to accommodate these stresses has resulted in increased production costs. It has also been necessary to position the screw so that the keyway faces to the side of the chair to avoid weakening the screw in a fore and aft direction, where the major forces in a swivel chair of this type are encounterd. This introduces additional expense into the assembly cost of the chair.

It is an object of the present invention, therefore, to provide an improved swivel chair requiring no keyway in the main screw and which is therefore advantageous from the standpoint of strength, and is also economical to manufacture because it eliminates machining costs for forming the keyway and additional assembly costs incident to orienting the keyway relative to the seat.

SUMMARY OF THE INVENTION

The main screw in the swivel chair of this invention is contained for rotational movement in an upright mounting assembly located in the base of the chair. The mounting assembly includes at least one washer loosely mounted on the screw at a position above and in contact with the top of a sleeve located in the base. The washer is made of low coefficient of friction material such as nylon or Teflon. A second washer, or ring shape member, made of high coefficient of friction material, such as rubber, is located concentrically on the first washer and is frictionally retained on the screw so that it rotates with the screw unless it is held against rotation. A nut is threadably mounted on the screw above the second washer. During rotation of the screw in response to rotation of the seat, the rubber washer grips the nut and the nylon washer and turns them identically with the screw.

The result is that the screw and the nut both rotate relative to the sleeve so that the vertical position of the seat is unchanged. The height of the chair may still be adjusted by rotating the nut manually on the screw. The swivel chair of this invention is advantageous because it does not require a keywayed main screw and thereby eliminates the cost of forming the keyway. The non-keywayed main screw also adds strength to the chair and simplifies assembly procedures heretofore developed to insure proper orientation of the keyway with respect to the chair.

Further objects, features and advantages of this invention will become apparent from a consideration of the following description, the appended claims, and the accompanying drawing which is a side elevational view of a swivel chair equipped with the main screw of this invention, with some parts broken away and other parts shown in section for purposes of clarity.

With reference to the drawing, the swivel chair of this invention, indicated generally at 10 in the drawing, is a conventional office type chair having a seat 12, a back 14, and a caster mounted base 16. A main screw 18 is secured to the seat 12 by means of a conventional mounting assembly (not shown) located on the underside of the seat 12. The screw 18 extends downwardly into a main screw mounting assembly 19 in the base 16. The essential function of the mounting assembly 19 is to maintain the screw 18 in an upright position and to provide a swivel support for the screw 18.

The mounting assembly 19 can take a variety of forms and is illustrated as consisting of an upright sleeve 20 which is press fit into a central opening 22 in the base 16. The sleeve 20 has an outwardly extending horizontal flange 24 at its upper end and has a top surface 26 which constitutes the top surface of the mounting assembly 19. At least one washer 27, formed of a material having low coefficient of friction characteristics, such as nylon or Teflon, is mounted concentrically on the sleeve 20 in engagement with the top surface 26.

A nut assembly, indicated generally at 28, is threadably mounted on the screw 18 and is shown in the drawing as comprising an internally threaded portion 32 and a hollow handwheel portion 34 which surrounds the portion 32. A ring shaped member 36, formed of material, such as rubber or the equivalent, having a substantially higher coefficient of friction than the material from which the washer 27 is formed, is frictionally mounted concentrically on the screw 18 so that it rotates identically with the screw 18 unless manually restrained. A set screw 42 is provided on the nut handwheel portion 34 and underlies the horizontal flange 24 so that when the seat 12 is lifted, the base 16 is also lifted.

During normal use of the chair 10, any rotation of the screw 18 in response to normal rotation of the seat 12, will cause the ring shaped member 36 to rotate with the screw 18. Since the screw and the member 36 engage the threaded portion 32 of the nut assembly 28, and there are no forces restraining rotation of the nut assembly 28, it will rotate identically with the screw 18. The frictional force of the bottom surface of the member 36 on the washer 27 may cause the washer 27 to rotate on the sleeve surface 26, or the member 36 may rotate relative to the washer 27, or the washer 27 may rotate with respect to both the surface 26 and the member 36. In any event the member 36 and the nut assembly 28 move with the screw 18 to insure that the vertical position of the seat 12 relative to the base 16 remains unchanged. The structure between the member 36 and the surface 26 can take various forms, the essential function of this structure being to insure ease of rotation of member 36 relative to base 16.

When it is desired to change the vertical position of the seat 12 with respect to the base 16, all that is required is relative rotation of the screw 18 and the nut assembly 28. For example, when the nut 28 is held stationary, by manually grasping the handwheel portion 34, the seat 12 can be rotated so as to move the screw 18 up in the nut 28, the portion 32 of which will force the member 36 downwardly on screw 18. When seat 12 is rotated to move screw 18 downwardly, it turns inside nut portion 32 and member 36. The result is an economical swivel chair with improved structural strength characteristics.

What is claimed is:

1. In a swivel chair having a seat member, a main screw member secured to and extending downwardly from said seat member, a supporting base, and a tubular main screw mounting assembly located on said base, said screw being positioned for rotational movement in said mounting assembly, a washer positioned concentrically on said mounting assembly and formed of material having a low coefficient of friction, a ring shaped member frictionally mounted on said screw so that in the absence of external forces thereon said ring shaped member is maintained in a fixed position on said screw during rotation of said screw, said ring shaped member being positioned concentrically on said washer in contact with the top surface thereof and being formed of material having a substantially higher coefficient of friction than the material from which said washer is formed, and a nut threadably mounted on said screw at a position above and in contact with the top side of said ring shaped member so that rotation of said seat and screw causes identical rotation of said ring shaped member and said nut, thereby precluding any change in the vertical position of said seat as a result of rotation thereof, only relative rotation of said screw and said nut being effective to cause raising or lowering of said seat.

2. A swivel chair according to claim 1 wherein said main screw is provided with an uninterrupted external thread extending over at least a portion of the length of said screw on which said nut and said ring shaped member are mounted.

3. A swivel chair according to claim 1 wherein said main screw mounting assembly includes an upright sleeve member located in said base and having an open upper end, said screw being located concentrically in said sleeve, and said washer being supported on said sleeve.

* * * * *